US008695241B2

(12) United States Patent
Crosse

(10) Patent No.: US 8,695,241 B2
(45) Date of Patent: Apr. 15, 2014

(54) VERTICAL QUILT BASTING FRAME

(76) Inventor: Ann Crosse, Carseldine (AU)

( * ) Notice: Subject to any disclaimer, the term of this patent is extended or adjusted under 35 U.S.C. 154(b) by 0 days.

(21) Appl. No.: 13/518,228

(22) PCT Filed: Dec. 15, 2010

(86) PCT No.: PCT/AU2010/001689

§ 371 (c)(1),
(2), (4) Date: Jul. 17, 2012

(87) PCT Pub. No.: WO2011/085428

PCT Pub. Date: Jul. 21, 2011

(65) Prior Publication Data

US 2012/0279097 A1 Nov. 8, 2012

(30) Foreign Application Priority Data

Jan. 12, 2010 (AU) ..... 2010100030

(51) Int. Cl.
*D06C 3/08* (2006.01)
*D06C 3/00* (2006.01)

(52) U.S. Cl.
USPC ..... 38/102.1

(58) Field of Classification Search
USPC ..... 38/102–102.91; 112/118; 40/603
See application file for complete search history.

(56) References Cited

U.S. PATENT DOCUMENTS

| | | | | | |
|---|---|---|---|---|---|
| 308,406 | A | * | 11/1884 | Elder | 38/102.21 |
| 1,239,877 | A | | 9/1917 | Bush | |
| 1,895,715 | A | * | 1/1933 | James | 38/102.21 |
| 4,658,521 | A | * | 4/1987 | Thorpe | 38/102.6 |
| 4,736,535 | A | * | 4/1988 | Rucker | 38/102.3 |
| 5,636,461 | A | * | 6/1997 | Shewmaker | 38/102.1 |
| 5,782,193 | A | | 7/1998 | Schwarzberger et al. | |
| 5,870,840 | A | * | 2/1999 | Geils et al. | 38/102.21 |
| 6,631,688 | B1 | * | 10/2003 | Maag | 112/118 |
| 7,191,555 | B2 | * | 3/2007 | Hughes | 40/603 |
| 7,581,343 | B1 | | 9/2009 | Baxter | |

OTHER PUBLICATIONS

Jul. 21, 2011, International Search Report for PCT/AU2010/0016989.

* cited by examiner

*Primary Examiner* — Ismael Izaguirre
(74) *Attorney, Agent, or Firm* — Neifeld IP Law, PC

(57) ABSTRACT

A vertical quilt basting frame (100) enables an improved quilting experience. The frame (100) includes four frame members (105, 110, 115, 120) defining a rectangle. At least one leg member (125) extends from at least one of the frame members (105, 110, 115, 120). A plurality of fabric side panels (150, 155, 160, 165) are attached to each of the four frame members (105, 110, 115, 120), wherein the fabric side panels (150, 155, 160, 165) define a workspace window (170) inside of the rectangle.

10 Claims, 5 Drawing Sheets

VERTICAL QUILT BASTING FRAME

CROSS REFERENCE TO RELATED APPLICATIONS

This application is a national stage entry of PCT/AU2010/001689, filed Dec. 15, 2010, which claims priority to Application No. AU 2010100030, filed Jan. 12, 2010.

FIELD OF THE INVENTION

The invention relates to quilting. In particular, the invention relates to a quilting frame for vertically supporting quilt components during hand arrangement and assembly of a quilt.

BACKGROUND TO THE INVENTION

Quilting has been practiced throughout the world for many centuries. Quilts were used originally as blankets or bed covers to keep people warm. Today, quilts are usually made by small business manufacturers or as a hobby by individuals or quilting groups, and are often intended to function as decorative bed covers, wall hangings, or as framed works of art. A quilt generally includes a backing layer, interior batting material, and decorative top layer comprising small fabric panels stitched together.

Generally a quilt is made by first stretching a backing layer over a solid horizontal surface such as a table or the floor, or a horizontal rigid frame in the case of manufacturers or more prolific hobbyists. The backing layer is temporarily attached to the horizontal surface or frame using tapes or various types of clamping mechanisms. Batting material is then applied over the backing layer. Finally the decorative top layer, comprising individual fabric panels that have been stitched together previously, is applied over the batting material and all three layers are pinned or tacked together to stabilise positioning of the layers prior to final stitching of the quilt.

The prior art includes various types of quilting frames for use in hand quilting and machine quilting, including the following:

U.S. Pat. No. 6,839,992 describes a quilting frame apparatus. The apparatus comprises concentric rectangular outer and inner frames. The outer frame is constructed from four elongate members attached in a mortise-and-tenon arrangement at each of its four corners and secured by wingnuts. The quilting frame may be adjusted at different angles to suit the user.

U.S. Pat. No. 6,757,996 describes a portable multiple use quilting frame system. The system is intended for both free hand and machine quilting and includes a pair of frame ends supported by three rods. The rods hold material to be quilted. As the quilting process progresses, the material is wound onto a take-up rod.

U.S. Pat. No. 7,581,343 describes a quilt display frame. The frame includes a sheet of flexible material having a peripheral edge with a plurality of sleeves. Poles are placed within the sleeves and are connected to one another to form a frame member. A connector is employed that includes a pair of tubes that are connected to each other by a bridge and a pair of legs are clipped onto the poles to support the frame on a surface in an upright position. A surface of the sheet is then used for holding patches for previewing a quilt design.

U.S. Pat. No. 6,209,240 describes a textile holding frame. The frame includes a pair of side members and two or more lateral members extending between the sides to define a generally rectangular configuration. One embodiment uses stationary frame members with retainers for material retention and/or tensioning, and another embodiment uses rotating frame members to provide desired tensioning.

U.S. Pat. No. 6,151,816 describes a portable quilting frame assembly. The assembly includes two complementary support structures each of which includes a base member, an elevation member, and a fulcrum member. The two complementary support structures are coupled by a cross member which spans the distance between the two complementary support structures. Coupled to each of the fulcrum members at a fulcrum end is a rail assembly for tensioning material.

U.S. Pat. No. 5,987,789 describes a stitchery stand and frame assembly. The assembly includes a stand having spaced posts which are connected together at their lower ends by a box assembly into which a tongue is slidably mounted. A frame unit connects the upper end of the posts. The frame unit includes a working frame wherein the side members and spanning members are connected together by being inserted into corner connectors. A fabric is mounted in a peripheral groove of the working frame.

U.S. Design Pat. No. 257,041 illustrates a quilting frame including two saw-horse members connected by rotatable horizontal rails.

U.S. Pat. No. 4,665,638 describes a quilting frame designed to stretch and hold material while hand stitching bed quilts. It consists of a pair of legs that are adjustable in height and are free-standing when three rods for holding material are removed from the frame. A hand crank is provided for rotating the rods and a locking device is also employed for preventing rotation. Further tensioning is provided by a horizontal tensioning mechanism pivotal on link rods attached to one of a pair of horizontal rods.

U.S. Pat. No. 4,736,535 describes a vertical embroidery frame. The frame may be attached to a stationary surface such as a wall panel and includes multiple securing means to provide a horizontal adjustable retaining area at work space height, and an area above for vertical storage of a quilt. As each portion of a quilt is completed at the horizontal work station, the quilt can be stored and displayed vertically until it is complete.

However, the prior art fails to disclose a system for efficient hand arrangement of various sized quilts using a vertical frame that provides easy access to both sides of a quilt. There is therefore a need for an improved vertical quilt basting frame.

OBJECT OF THE INVENTION

It is an object of the invention to overcome or at least alleviate one or more of the deficiencies of the prior art and/or provide the consumer with a useful or commercial choice.

DISCLOSURE OF THE INVENTION

In one form, although it need not be the only or indeed the broadest form, the invention resides in a vertical quilt basting frame, comprising:

four frame members defining a rectangle;

at least one leg member extending from at least one of the frame members; and a plurality of fabric side panels attached to each of the four frame members, wherein the fabric side panels define a workspace window inside of the rectangle defined by the aforementioned four frame members.

Preferably, the four frame members define a part of one side of a box frame.

Preferably, the plurality of fabric side panels define a rectangular workspace window.

Preferably, the frame further comprises a plurality of fabric reducing panels attached to the plurality of fabric side panels, wherein the plurality of fabric reducing panels define a reduced size workspace window.

Preferably, the plurality of fabric side panels consists of a single piece of material.

Preferably, the frame further comprising a quilt backing material pinned to the fabric side panels.

Preferably, the frame further comprises:

four additional frame members defining a second rectangle and defining a second part of a second side of the box frame; and a second plurality of fabric side panels attached to each of the four additional frame members, wherein the second plurality of fabric side panels define a second workspace window inside of the second rectangle.

Preferably, the first rectangle is connected to the second rectangle by cross members.

Preferably, the four frame members comprise lightweight extruded aluminium hollow sections.

Preferably, the frame members are connected together using plastic connectors.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE INVENTION

Figure 1:
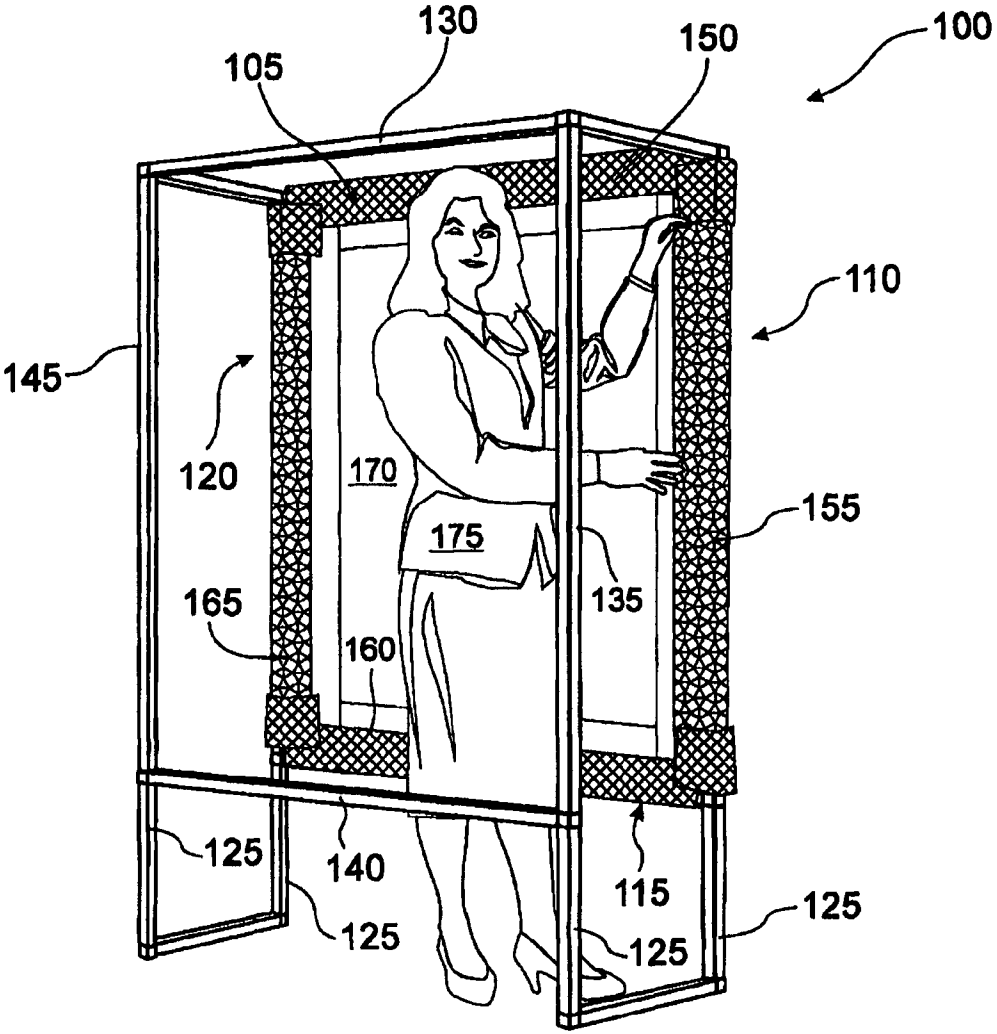
FIG. 1 is a perspective view illustrating a vertical quilt basting frame and plurality of fabric side panels according to an embodiment of the present invention.

A single embodiment of the present invention is presented in the drawings as an improved vertical quilt basting frame. Elements of the invention are illustrated in concise outline form, showing only those specific details that are necessary to understanding the embodiments of the present invention, but so as not to clutter the disclosure with excessive detail that will be obvious to those of ordinary skill in the art in light of the present description.

With reference to FIG. 1, a perspective view illustrates a vertical quilt basting frame 100 according to an embodiment of the present invention. The frame 100 includes four frame members consisting of two horizontal members 105, 115 and two vertical members 110, 120 that define a rectangle. Leg members 125 extend from a lower end of the frame 100 and support the frame 100 above the ground. Additional frame members 130, 135, 140, 145 define a second rectangle.

A plurality of fabric side panels 150, 155, 160, 165 are attached to each of the four frame members 105, 110, 115, 120 and define a workspace window 170 inside the rectangle defined by the frame members 105, 110, 115, 120. To provide an example of comparative scale of the frame 100, a person 175 is illustrated standing inside of the frame 100. For example, the frame 100 may be 1700 mm wide, 1800 mm high and 550 mm deep. The person 175 thus is provided easy access to a rear side of the workspace window 170.

Figure 2:
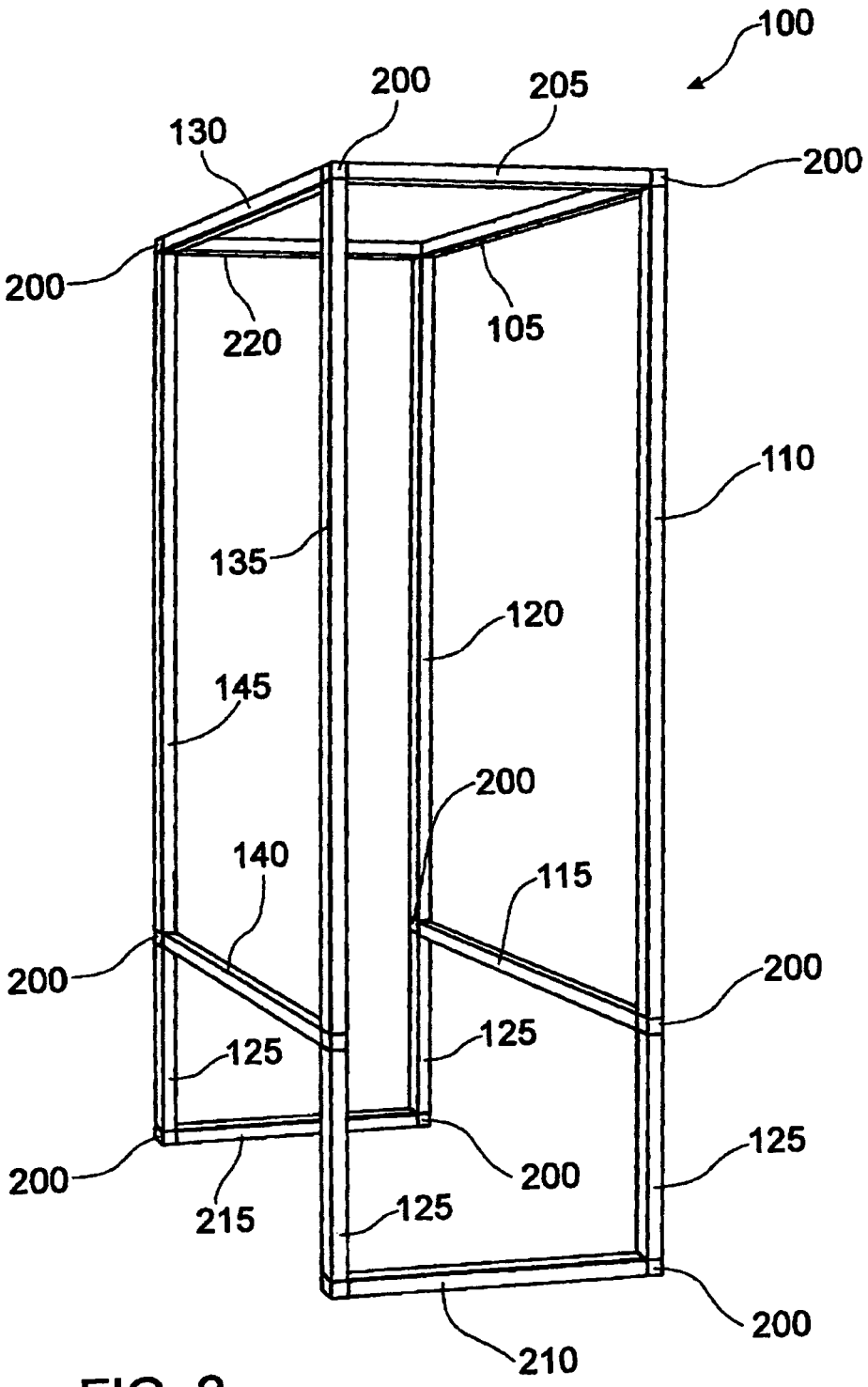
FIG. 2 is a perspective view of the vertical quilt basting frame of FIG. 1 illustrating the frame without a plurality of fabric side panels.

Referring to FIG. 2, a perspective view illustrates the vertical quilt basting frame 100 without the plurality of fabric side panels 150, 155, 160, 165. As shown, the additional frame members 130, 135, 140, 145 define a second rectangle, which in conjunction with frame members 105, 110, 115, 120 and cross members 205, 210, 215, 220 provide stability and define a box frame.

The frame members 105, 110, 115, 120, 130, 135, 140, 145, leg members 125 and cross members 205, 210, 215, 220 can be manufactured from various materials such as commercially available lightweight extruded aluminium hollow sections. Plastic connectors 200 are then used to connect the frame members 105, 110, etc. and cross members 205, 210, etc. together. As will be understood by those having ordinary skill in the art, various alternative materials, shapes and types of members and connectors may also be used.

Figure 3:
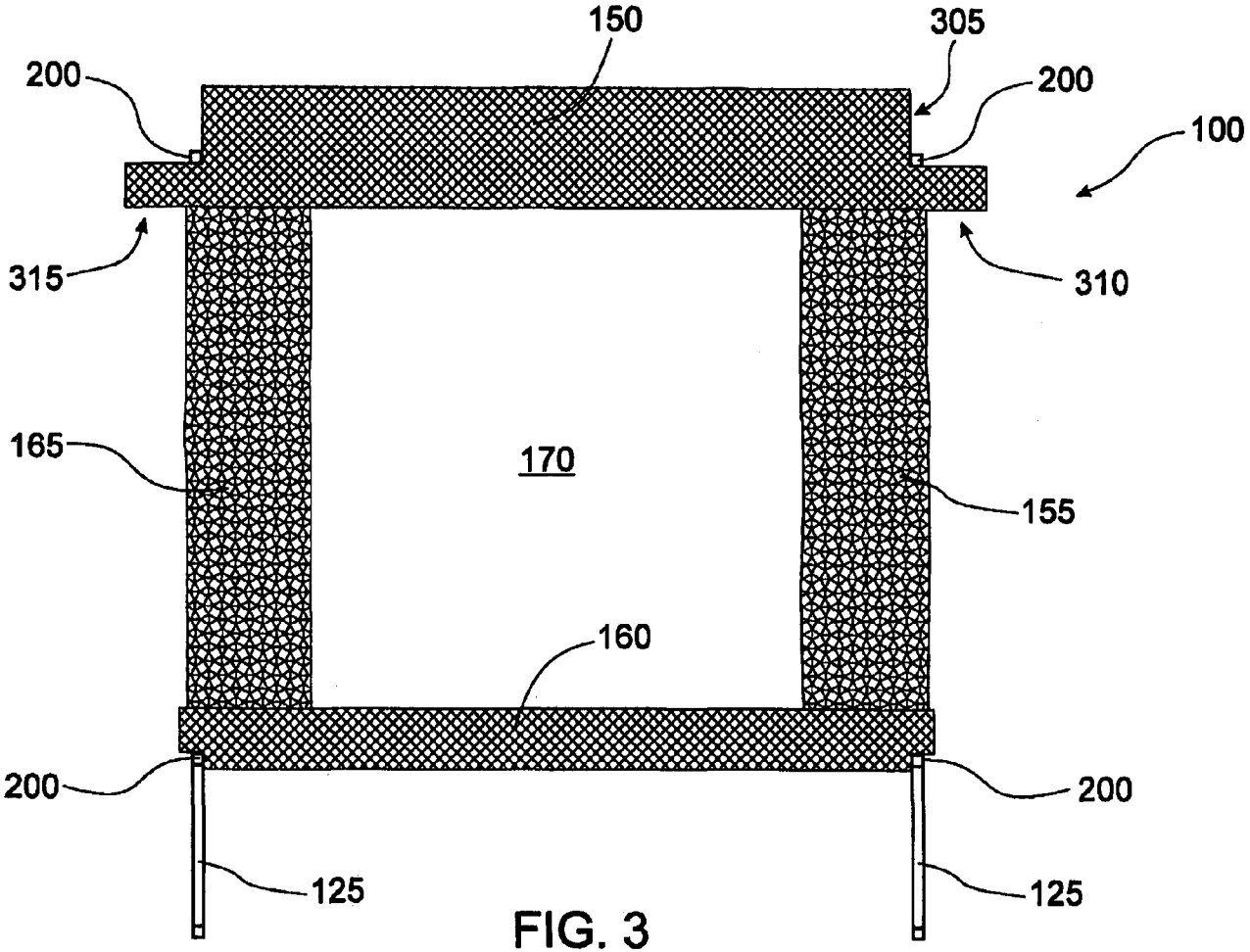
FIG. 3 is a front view of the vertical quilt basting frame of FIG. 1 further illustrating positioning of the plurality of fabric side panels.

Referring to FIG. 3, a front view of the vertical quilt basting frame 100 further illustrates positioning of the plurality of fabric side panels 150, 155, 160, 165. The fabric side panel 150 is shown in an unfolded and unattached arrangement. Tabs 305, 310, 315 then fold around, respectively, the frame members 105, 110, 120. A final look of the side panel 150 is then similar to the look of the side panel 160 shown in FIG. 3.

During use of the frame 100, a quilt backing material (not shown) is pinned to the fabric side panels 150, 155, 160, 165. Generally, the quilt backing material is a single backing sheet of fabric that is slightly larger than the area of the workspace window 170. A user, such as the person 175, is then provided convenient and unobstructed access to both a front side and a back side of the backing material. After the backing sheet is adequately attached, batting material or wadding and decorative top layer comprising pre-stitched fabric panels are pinned to the backing material. For example the layers of a quilt being produced, commonly referred to as a "quilt sandwich", can be pinned together at approximately 10 cm intervals both horizontally and vertically. After a user is satisfied that the layers are correctly aligned and pinned together correctly, the quilt sandwich can be removed from the frame 100 and completed by sewing in a usual manner.

Figure 4:
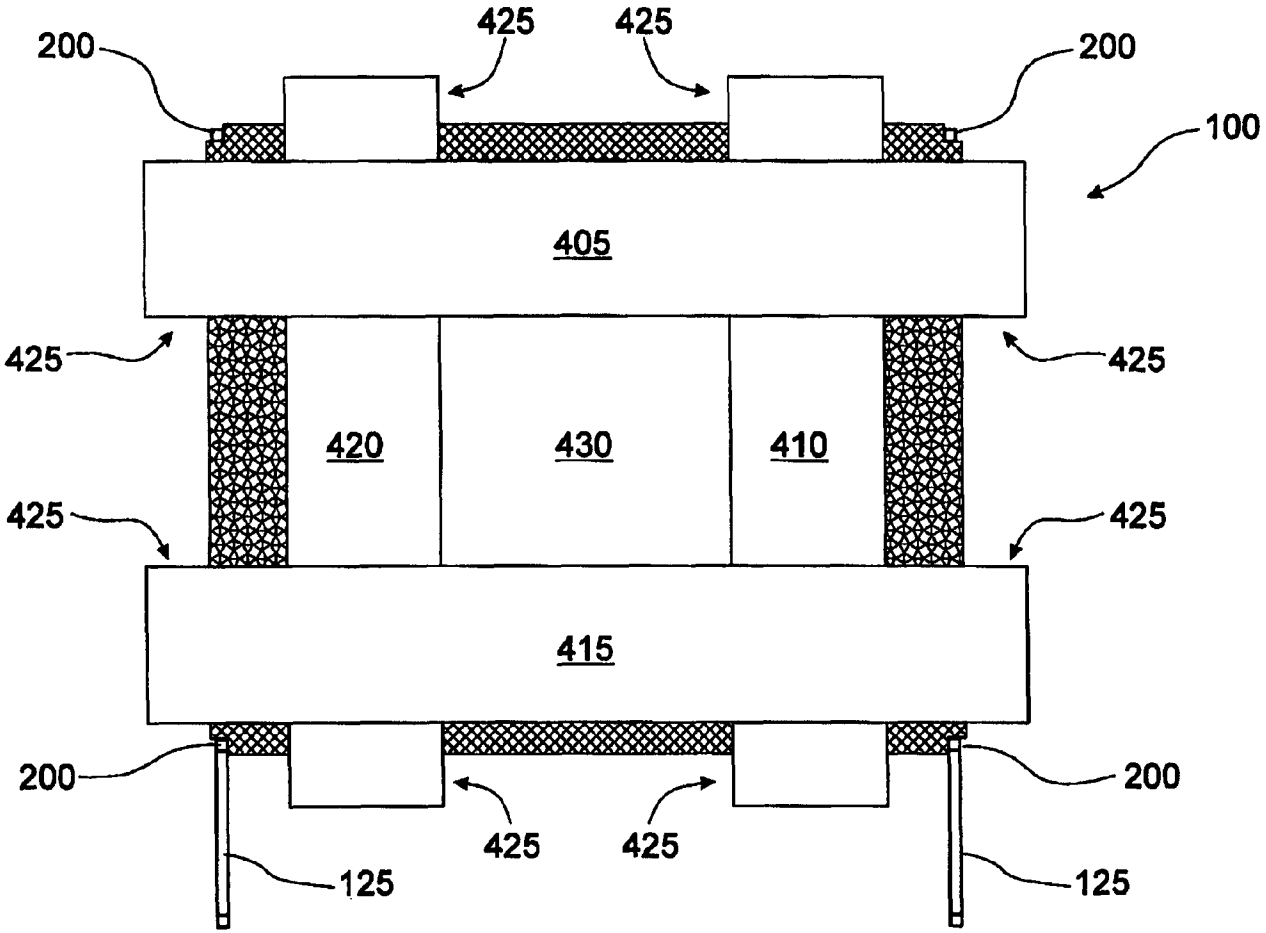
FIG. 4 is a front view of the vertical quilt basting frame of FIG. 1 further illustrating the use of fabric reducing panels, according to an embodiment of the present invention.

Referring to FIG. 4, a front view of the vertical quilt basting frame 100 further illustrates the use of fabric reducing panels 405, 410, 415, 420, according to an embodiment of the present invention. To enable quilting of smaller quilts having an area smaller than the workspace window 170, the fabric reducing panels 405, 410, 415, 420 can be attached to the fabric side panels 150, 155, 160, 165. For example, tabs 425 can be folded around the frame members 105, 110, 115, 120 to secure the fabric reducing panels 405, 410, 415, 420 in place and define a reduced size workspace window 430. As described above, quilt backing material (not shown) is then pinned to the fabric reducing panels 405, 410, 415, 420.

Figure 5:
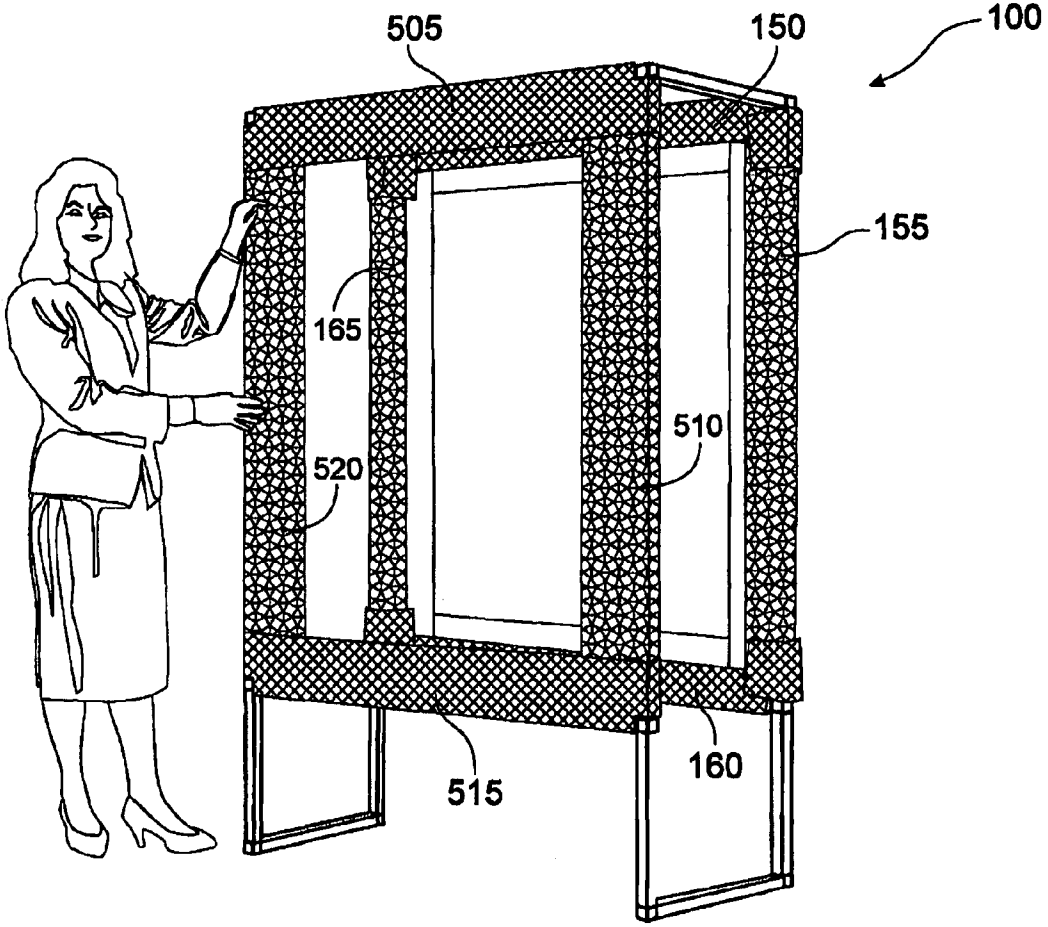
FIG. 5 is a perspective view of the quilting frame of FIG. 1 illustrating how additional fabric side panels can be attached to additional frame members, according to an embodiment of the present invention.

Referring to FIG. 5, a perspective view illustrates how additional fabric side panels 505, 510, 515, 520 can be attached to the additional frame members 130, 135, 140, 145, according to an embodiment of the present invention. That enables two quilts to be hung simultaneously from the vertical quilt basting frame 100, and includes convenient access to the front and back sides of both quilts.

Embodiments of the present invention thus include the following advantages:

Vertical orientation of a quilting frame uses less floor space, allows for easy access to both sides of a quilt, enables gravity to assist in evening out layers of a quilt, and provides reduced strain on a user's body as kneeling and bending to access a quilt are not required.

Lightweight construction allows for easy moving of the quilting frame with or without a quilt attached.

Two or more quilts can be assembled simultaneously using opposing sides of a box frame to support the quilts.

Quilts of varying sizes can be assembled using various sized workspace windows.

Frames of the present invention also can be used to display one or more completed quilts.

In this patent specification, adjectives such as front and back, top and bottom, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those having ordinary skill in the art. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the claims.

The invention claimed is:

1. A vertical quilt basting frame, comprising:

four frame members defining a rectangle;

at least one leg member extending from at least one of the frame members;

a plurality of fabric side panels attached to each of the four frame members, wherein the fabric side panels define a first workspace window inside of the rectangle; and a plurality of fabric reducing panels attached to the plurality of fabric side panels, wherein the plurality of fabric reducing panels define a reduced size first workspace window.

2. The frame of claim 1, wherein the four frame members define a part of a first side of a box frame.

3. The frame of claim 1, wherein the plurality of fabric side panels define a rectangular first workspace window.

4. The frame of claim 1, wherein the plurality of fabric reducing panels consists of two fabric reducing panels.

5. The frame of claim 1, wherein the plurality of fabric side panels consists of a single piece of material.

6. The frame of claim 1, further comprising a quilt backing material pinned to the fabric side panels.

7. A vertical quilt basting frame, comprising:

four frame members defining a rectangle;

at least one leg member extending from at least one of the frame members;

a plurality of fabric side panels attached to each of the four frame members, wherein the fabric side panels define a first workspace window inside of the rectangle;

wherein the four frame members define a part of a first side of a box frame;

further comprising four additional frame members defining a second rectangle and defining a second part of a second side of the box frame; and a second plurality of fabric side panels attached to each of the four additional frame members, wherein the second plurality of fabric side panels define a second workspace window inside of the second rectangle.

8. The frame of claim 7, wherein the first rectangle is connected to the second rectangle by cross members.

9. The frame of claim 1, wherein the four frame members comprise lightweight extruded aluminium hollow sections.

10. The frame of claim 1, wherein the frame members are connected together using plastic connectors.

* * * * *